US007462402B2

(12) United States Patent
Coelho et al.

(10) Patent No.: US 7,462,402 B2
(45) Date of Patent: Dec. 9, 2008

(54) PUNCH, APPARATUS AND METHOD FOR FORMING OPPOSING HOLES IN A HOLLOW PART, AND A PART FORMED THEREFROM

(75) Inventors: Jose U. Coelho, London (CA); David J. Dunn, St. Thomas (CA); Martin L. Bliss, Thorndale (CA)

(73) Assignee: Vari-Form Inc., Strathroy, Ontario (CA)

( * ) Notice: Subject to any disclaimer, the term of this patent is extended or adjusted under 35 U.S.C. 154(b) by 0 days.

(21) Appl. No.: 11/785,950

(22) Filed: Apr. 23, 2007

(65) Prior Publication Data

US 2007/0193323 A1 Aug. 23, 2007

Related U.S. Application Data

(62) Division of application No. 11/330,197, filed on Jan. 12, 2006.

(51) Int. Cl.
*B21D 28/02* (2006.01)
*B21D 28/28* (2006.01)

(52) U.S. Cl. ..... 428/597; 428/603

(58) Field of Classification Search ..... 428/597
See application file for complete search history.

(56) References Cited

U.S. PATENT DOCUMENTS 2,135,417 A * 11/1938 Tinnerman ..... 72/326
3,685,336 A * 8/1972 Black, Jr. ..... 72/325
4,989,482 A 2/1991 Mason
5,398,533 A 3/1995 Shimanovski et al.
5,666,840 A 9/1997 Shah et al.
5,816,089 A 10/1998 Marando
6,067,830 A 5/2000 Klages et al.
6,109,086 A * 8/2000 Gambrel et al. ..... 72/326
6,305,201 B1 10/2001 Ghiran et al.
6,658,908 B1 12/2003 Ghiran et al.
2006/0065030 A1 3/2006 Ghiran et al.

FOREIGN PATENT DOCUMENTS

WO WO 01/08829 A1 2/2001

* cited by examiner

*Primary Examiner*—John J Zimmerman
(74) *Attorney, Agent, or Firm*—Reising, Ethington, Barnes, Kisselle, P.C.

(57) ABSTRACT

A punch, apparatus and method for forming opposing holes in a hollow part, and a part formed therefrom. The punch includes an end portion adapted to pierce an entry hole and bend material around the entry hole to form a retained slug along an inner edge of the entry hole. The punch also includes an enlarging portion adapted to enter the entry hole after the end portion to enlarge the entry hole by bending the slug and additional material towards the interior' of the part. The punch has a length greater than a cross-section of the part such that further advancement of the punch through the part punches an exit hole in the part opposite the entry hole.

5 Claims, 3 Drawing Sheets

PUNCH, APPARATUS AND METHOD FOR FORMING OPPOSING HOLES IN A HOLLOW PART, AND A PART FORMED THEREFROM

REFERENCE TO RELATED APPLICATION

This application is a divisional of U.S. patent application Ser. No. 11/330,197, filed Jan. 12, 2006, currently pending, whose disclosure is being incorporated by reference in its entirety into the present disclosure.

FIELD OF THE INVENTION

This application relates to a punch, apparatus and method for forming opposing holes in a hollow part, and a part formed therefrom.

BACKGROUND OF THE INVENTION

Opposing or aligned holes are sometimes required in hollow parts, such as for connecting mechanical fasteners therethrough. The inside of the part may be pressurized to assist a punch in producing a hole in the part. For example, in the hydroforming of parts from a hollow metal part, the hydroforming pressure is used to assist the punch in producing the hole in the part. This eliminates the need for a secondary operation such as drilling or laser cutting to form the hole in an internally unsupported region of the part.

In a typical punching operation for a hydroformed part, as the punch is advanced to engage the forward surface of the material, the rearward surface is supported by the pressurized fluid. Upon further advancement of the punch through the material to shear a slug, the pressurized fluid continues to bear upon the material to be removed as a slug, as well as upon adjacent material. The slug is sheared under the mechanical force applied to the material by the cutting edge of the punch and the force applied to the material adjacent the slug by the pressurized fluid.

The presence of a loose slug within the part poses several problems. In many instances, the presence of a loose or detached slug within the part may not be identified for some time, or even after the part has been installed in a finished product. Many systems have been developed to capture slugs formed by the punching operation. See, for example, U.S. Pat. No. 4,989,482 (Mason), issued Feb. 5, 1991, and assigned to the assignee of the present application. Slug capture is also an issue in applications where opposing holes are to be formed in the part. Examples of methods for obtaining slugs formed by such operations are described in U.S. Pat. No. 5,666,840 (Shah et al.), and in U.S. Pat. No. 6,067,830 (Klages et al.), issued May 30, 2000, and assigned to the assignee of the present application.

SUMMARY OF THE INVENTION

A punch, apparatus and method for forming opposing holes in a hollow part, and a part formed therefrom. are described. The punch pierces or cuts an entry hole in the part without shearing a slug as the slug is folded back and is retained near a periphery of the entry hole. The punch bends or rolls back material around the pierced entry hole to obtain the required sized opening. Further advancement of the punch through the part shears an exit hole opposite the entry hole.

The present invention also provides a method of forming two opposing holes through an open tube section or other hollow part with a single actuated punch in a single motion. The opposing holes differ in size with the entry hole being larger than the exit hole. The holes are preferably round but may be any desired shape. The resultant slug material from the larger entry hole is retained along the inner edge of the hole within the tube section and the smaller exit hole is pierced or cut to form a slug that is pushed out of the tube section and mold cavity.

According to one aspect of the present invention, there is provided a punch for forming opposing holes in a hollow part. The part is internally pressurized by a hydroforming fluid. The punch comprises an end portion that is adapted to pierce an entry hole and bend material around the entry hole to form a retained slug along an inner edge of the entry hole. The punch has a length greater than a cross-sectional width of the part such that further advancement of the punch through the part punches an exit hole in the part opposite the entry hole. The punch may further comprise an enlarging portion that is adapted to enter the entry hole after the end portion to enlarge the entry hole by shearing material to create a larger hole and bending this slug material towards the interior of the part.

According to another aspect of the present invention, there is provided a punch for forming opposing holes in a hollow part. The part is internally pressurized by a hydroforming fluid. The punch comprises an end portion having a cutting edge and an edge rolling surface extending partially around the punch. The cutting edge is adapted to pierce an entry hole in the part and the end face bends material around the entry hole to form a retained slug along an inner edge of the entry hole. The edge rolling surface is adapted to shear the material to generate a larger hole and to bend the retained slug material into the part. The punch has a length greater than a cross-section of the part such that further advancement of the punch through the part punches an exit hole in the part opposite the entry hole. The punch may further comprise an enlarging portion adapted to enter the entry hole after the end portion. The enlarging portion has at least one edge rolling surface adapted to further enlarge the entry hole by bending the slug and additional material around the entry hole towards the interior of the part.

According to a further aspect of the present invention, there is provided a punch for forming opposing holes in a hollow part. The part is internally pressurized by a hydroforming fluid. The punch comprises an end portion having an end face, a cutting edge, and an angled surface extending outward at an acute angle from the end face. The cutting edge is adapted to pierce an entry hole in the part and the end face bends material around the entry hole to form a retained slug along an inner edge of the entry hole. The angled surface extends at least partially around the punch to bend the slug towards the interior of the part. The punch has a length greater than a cross-section of the part such that further advancement of the punch through the part punches an exit hole in the part opposite the entry hole. The punch may further have an enlarging portion joined to the end portion. The enlarging portion includes first and second angled surfaces located on opposite sides of the punch. The first and second angled surfaces extend outwardly at an acute angle and at least partially around the punch. The first and second angled surfaces are adapted to enlarge the entry hole by bending the slug and additional material around the entry hole further towards the interior of the part.

According to a further aspect of the present invention, there is provided a method for forming opposing holes of differing size in a hollow part. The part is internally pressurized by a hydroforming fluid. The method comprises the steps of: piercing an entry hole in the part; performing a first rolling step in which material around the entry hole is bent towards the interior of the part to form a retained slug located about the entry hole and extending towards the interior of the part; and forming an exit hole in the part opposite the entry hole. The exit hole is smaller than the entry hole. The method may further comprise the step of performing a second rolling step in which the retained slug and additional material around the entry hole are bent further towards the interior of the part before the step of forming an exit hole.

According to a further aspect of the present invention, there is provided a hollow metal part. The hollow metal part comprises a hollow metal body having opposed entry and exit holes. The entry hole is larger than the exit hole. The hollow metal body includes a rolled edge portion extending around the entry hole. The rolled edge portion extends towards the interior of the part. A pair of secondary retained slugs joins along an edge of the rolled edge portion. The slugs are located on opposite sides of the rolled edge portion and a first retained slug is joined along an edge of one of the secondary retained slugs.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to the accompanying drawings which show, by way of example, embodiments of the present invention, and in which.

Figure 1:
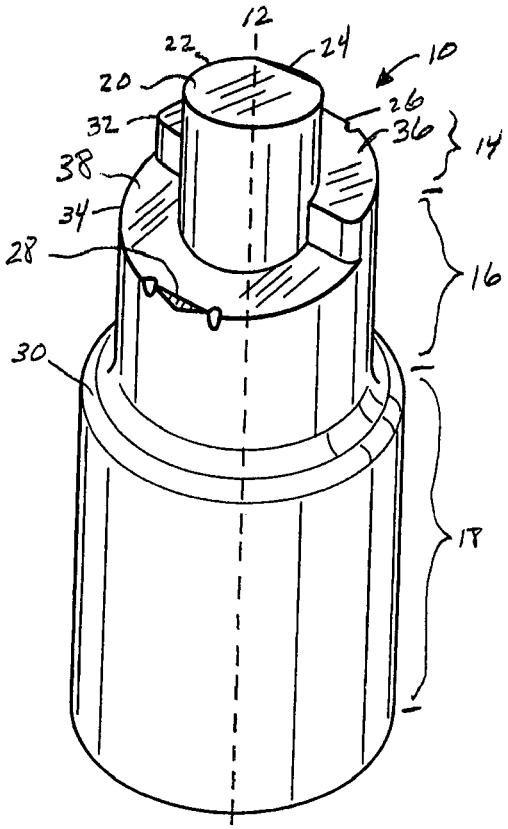
FIG. 1 is a perspective view taken from above a punch according to one embodiment of the present invention.

Similar references are used in different figures to denote similar components.

DETAILED DESCRIPTION OF THE EMBODIMENTS

Referring briefly to FIGS. 5A to 5F, a portion of a hydroforming apparatus 100 suitable for using the present invention will be described. The apparatus 100 comprises a lower die 102 and an upper die 104 that combine to form a die cavity 106 in which a tubular metal part is hydroformed to the die cavity surface. The hydroforming of the tubular metal part is accomplished by the delivery of a suitable hydraulic fluid 108 at a desired pressure to the interior of the tubular metal part resulting in a hydroformed part 110, as shown.

Reference is now made to FIGS. 1 to 4, which show one embodiment of a punch 10 according to the present invention. The punch 10 is typically used to form opposing holes in a flat wall portion of an internally pressurized part. While the present embodiment is described as applied to a flat wall portion, the punch 10 may also be used on curved wall portions. The punch 10 is particularly adapted for punching opposed entry and exit holes of differing size in a hydroformed part during the hydroforming process while the part is internally pressurized by the hydroforming fluid 108.

The punch 10 has a central longitudinal axis 12. The punch 10 is made of tool steel and has three body portions formed concentrically about its axis 12 including an end portion 14, an enlarging portion 16, and a finishing portion 18. The body portions are generally cylindrical in shape and have cylindrical outer surfaces for forming circular entry and exit holes, although the punch 10 generally has no constant diameter as the diameter increases from top to bottom. The body portions may have a different shape in applications where non-circular hole shapes are required.

The end portion 14 is adapted to pierce an entry hole in the part without completely shearing a slug. Instead, the slug is retained along an inner edge of the entry hole. The enlarging portion 16 enlarges the entry hole by shearing and bending or rolling back material around the entry hole, including the retained slug. The finishing portion 18 finishes the punching operation of the entry hole by providing a rolled edge portion to the entry hole. Optionally, the finishing portion 18 further enlarges the hole by further bending or rolling back material away from the entry hole to reduce the risk of material around the entry hole interfering with a subsequent operation of a mechanical fastener.

The punch 10 has a length (e.g., a stroke distance) greater than a cross-section of the part such that further advancement of the punch 10 through the part forms an exit hole in the part opposite the entry hole. The enlarging portion 16 and the finishing portion 18 have a cross-sectional area larger than that of the end portion 14. In instances where the presence of bent back material immediately adjacent the entry hole does not interfere with subsequent operations, the punch 10 may not include a finishing portion 18.

The end portion 14 has an end face 20, a sharp cutting edge 22, and an edge rolling surface 24 extending partially around the punch 10. The cutting edge 22 is adapted to pierce the entry hole. As the punch is advanced through the part, the end face 20 engages and presses against the part, forcibly bending or rolling the material around the pierced entry hole to form a slug integral with the part along the inner edge thereof. Advancement of the punch 10 bends or rolls the slug towards the interior of the part. The edge rolling surface 24 is adapted to engage and forcibly bend or roll back the slug towards the interior of the part and clear of the advancing punch 10. In the shown embodiment, the end face 20 is angled or tapered at an acute angle or beveled. The angling of the end face 20 may assist in bending or rolling back the material around the pierced entry hole.

As shown in FIGS. 1 to 4, the edge rolling surface 24 is formed by a bevel or an angled or tapered surface that extends radially outward at an acute angle from the end face 20. Where the end face 20 is angled, the edge rolling surface 24 is positioned at a different angle than the end face 20. The edge rolling surface 24 extends partially around the end face 20 of the punch 10.

The enlarging portion 16 includes two edge rolling surfaces 26 and 28 located on opposite sides of the punch 10 and extending partially around the punch 10. The edge rolling surfaces 26 and 28 are adapted to enter the entry hole after the end portion 14 to enlarge the entry hole by bending or rolling back the slug and additional material around the entry hole towards the interior of the part. The action of the edge rolling surfaces 26 and 28 forms two secondary retained slugs along the inner edge of the enlarged entry hole. The secondary slugs are located about the peripheral edge of the entry hole on opposite sides of the punch 10.

In the shown embodiment, the edge rolling surfaces 26 and 28 are adjacent to first and second stepped portions indicated by references 32 and 34 respectively. The first stepped portion 32 is adjacent the end portion 14 and includes a first angled or tapered end face 36. The second stepped portion 34 is adjacent the first stepped portion 32 and includes a second angled or tapered end face 38. The first angled end face 36 extends radially outward at an acute angle from the end portion 14. The second angled end face 38 extends radially outward at an acute angle from the end portion 14.

Figure 2:
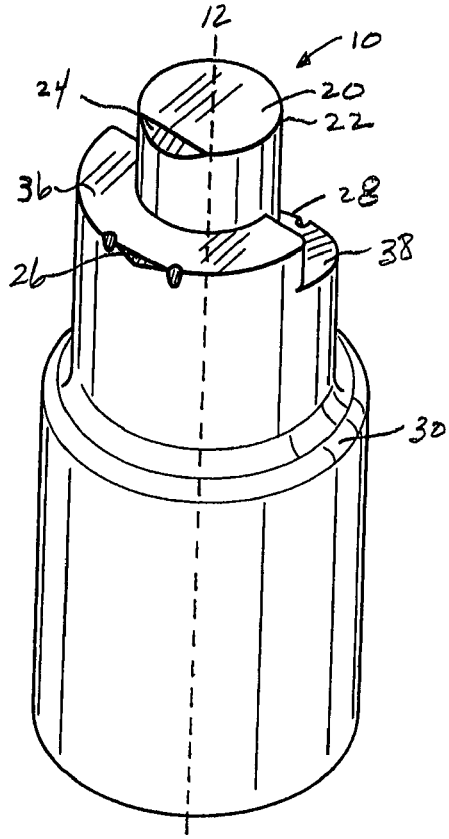
FIG. 2 is a perspective view taken from above the opposite side of the punch of FIG. 1.
Figure 3:
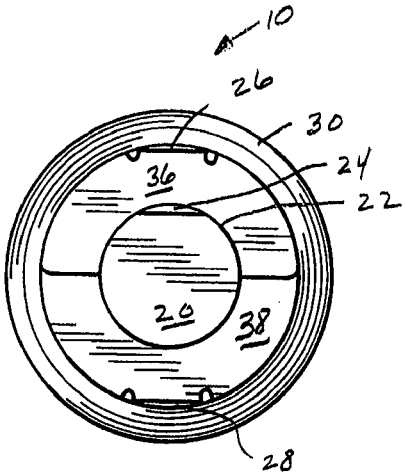
FIG. 3 is a top view of the punch of FIG. 1.
Figure 4:
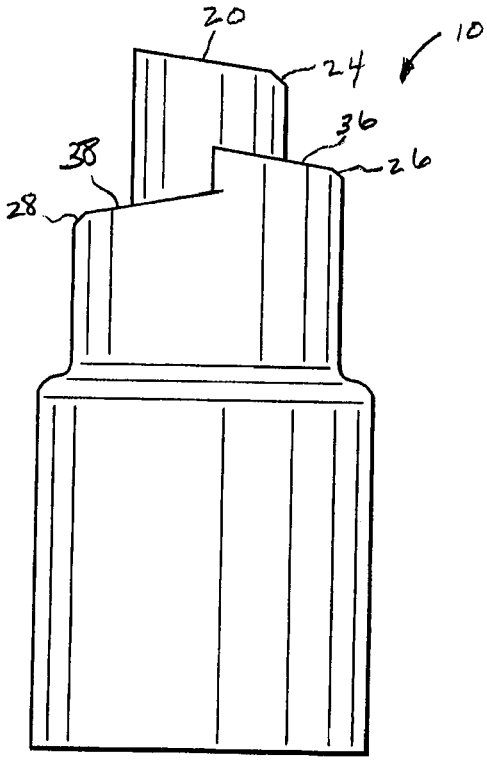
FIG. 4 is a side view of the punch of FIG. 1.

The first and second angled end faces 36 and 38 intersect different planes perpendicular to the central longitudinal axis 10 relative to each other. As shown in FIGS. 1 and 2, the first and second angled end faces 36 and 38 are each located at an axial distance from the end portion 14. The distance of the second angled end face 38 from the end portion 14 is further than the distance of the first angled end face 36 from the end portion 14.

The first and second edge rolling surfaces 26 and 28 are located on opposite sides of the punch 10. The first edge rolling surface 26 is aligned with the edge rolling surface 24 of the end portion 14 on the same side of the punch 10. Accordingly, the second edge rolling surface 28 is positioned on the opposite side of the punch 10 relative to the edge rolling surface 24 and the edge rolling surface 26. In other embodiments the edge rolling surface 26 may not be aligned with the edge rolling surface 24 and the edge rolling surfaces 26 and 28 may not be located opposite each other.

As shown in FIGS. 1-4, one or both of the end faces 36 and 38 may be angled or tapered at an acute angle. In such embodiments, the angle of the end face 36 of the first stepped portion 32 is different than the angle of the edge rolling surface 26. Likewise, in such embodiments, the angle of the end face 38 of the second stepped portion 34 is different than the angle of the edge rolling surface 28. The angling of the end faces 36 and 38 may assist in the bending or rolling back of the slug material around the entry hole.

In the shown embodiment, the enlarging portion 16 is evenly divided into the first and second stepped portions 32 and 34 such that the surface areas of the end faces 36 and 38 is approximately equal. As will be described in more detail below, this configuration produces generally half-cylindrical shaped slugs. Other configurations will produce differently shaped slugs.

The finishing portion 18 has at least one edge rolling surface 30 that is adapted to enter the entry hole after the enlarging portion 16 to provide the entry hole with a rolled edge portion. Optionally, the finishing portion 18 may be configured to further enlarge the entry hole by bending or rolling back the slug(s) and additional material around the entry hole further towards the interior of the part. In the shown embodiment, the edge rolling surface 30 is a rounded or convexly shaped surface extending completely around the punch 10. However, in other embodiments the edge rolling surface 30 may extend only partially around the punch 10 and may have a different shape. In some embodiments, the edge rolling surface 30 is an angled or tapered surface extending radially outward at an acute angle. The edge rolling surface 30 may also be a conically profiled surface.

Referring again to FIGS. 5A to 5F, an exemplary punching operation using the punch 10 will now be described. The punch 10 is mounted in the hydroforming apparatus 100 for sliding movement in a bore 112 in the lower die 102. The bore 112 extends to a surface of the die cavity 106. The base (not shown) of the punch 10 is adapted for connection with a suitable punch operating device, such as a hydraulic cylinder, by conventional means. The punch operating device is operated in a conventional manner for the hole forming operation during the hydroforming process. The outer surface of the punch 10 is adapted to provide sealing contact between the part 110 and the punch 10 sufficient to maintain the internal pressure of the hydroforming fluid 108 within the part 110 as the punch 10 advances through it. As will be appreciated by persons skilled in the art, the punch 10 is formed to prevent or minimize leakage of the hydroforming fluid 108 from the interior of the part 110 during the punching operation so as to produce the entry and exit holes without a significant loss of the hydroforming fluid 108.

Figure 5A:
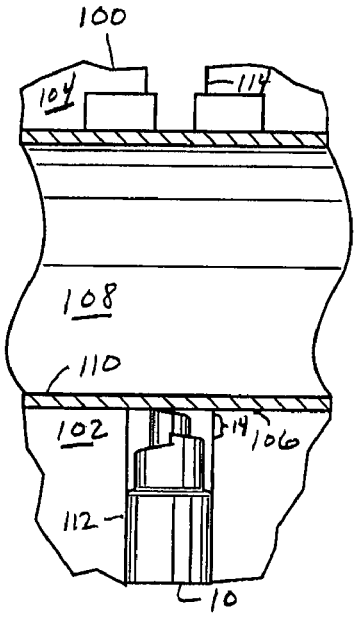
FIGS. 5A-5F are elevational views of the punch of FIG. 1 at progressive stages of a punching operation.
Figure 5B:
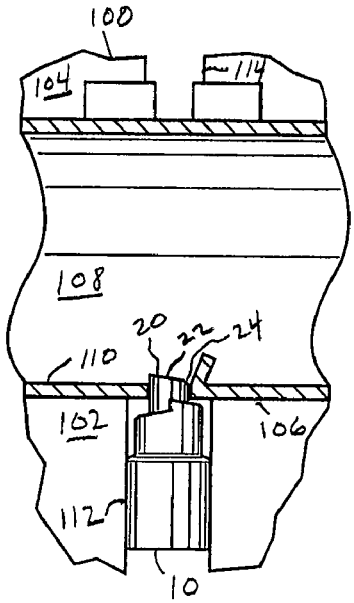

As shown in FIG. 5A, the end portion 14 of the punch 10 is initially positioned outside of the die cavity 106 opposite a flat wall portion of the hydroformed part 110. The punch 10 is then advanced towards the part 110. As shown in FIG. 5B, the cutting edge 22 engages the part 110 and pierces an entry hole starting with the punch 10 tip or distal end. As the punch 10 is further advanced, the end face 20 engages and presses against the part 110, forcibly bending or rolling the material around the pierced entry hole to form an initial slug retained along the inner edge of the entry hole, integral with the part 110. As the punch 10 is further advanced,. the edge rolling surface 24 engages the part 110 and forcibly bends or rolls the slug towards the interior of the part 110 (due to the lack of the cutting edge 22 on the end face 20 where the edge rolling surface 24 resides), away from and clear of the entry hole. The shape of the edge rolling surface 24 allows the slug to be bent out of the way of the advancing punch 10 without completely shearing the slug from the part 110, allowing the slug to remain integral with the part 110 along its inner edge. The slug material size varies depending on the size of the entry hole to be formed.

Figure 5C:
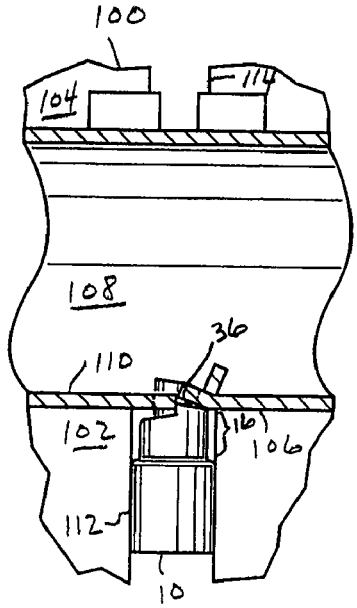

As shown in FIG. 5C, as the punch 10 is further advanced into the part 110, the enlarging portion 16 engages the part 110. The first angled end face 36 first engages additional material around the entry hole, forcibly bending or rolling the additional material towards the interior of the part 110. The additional material which has been bent or rolled towards the interior of the part 110 forms the first of two secondary retained slugs.

Figure 5D:
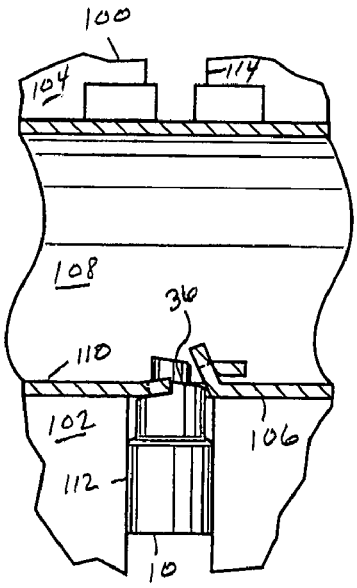

As shown in FIG. 5D, as the punch 10 is further advanced into the part 110, the first angled end face 36 engages the initial retained slug formed by the end portion 14 and the additional material around the entry hole, forcibly bending or rolling it further towards the interior of the part 110. As the punch 10 is further advanced, the second angled end face 38 engages material around the entry hole on the opposite side of the punch 10 (as compared to the angled end face 36), forcibly bending or rolling the material towards the interior of the part 110. The material which has been bent or rolled towards the interior of the part 110 by the angled end face 38 forms the second of the two secondary retained slugs.

Figure 5E:
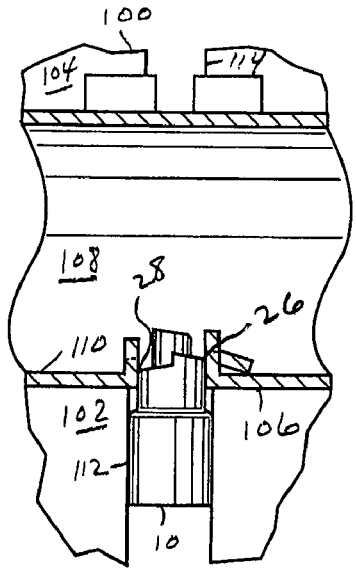

As shown in FIG. 5E, as the punch 10 is further advanced into the part 110, the edge rolling surface 26 further engages the initial slug and the first of the secondary slugs, forcibly bending or rolling the slugs further towards the interior of the part 110, away from and clear of the entry hole. At the same time, the edge rolling surface 28 further engages the second of the two secondary retained slugs, forcibly bending or rolling the slug towards the interior of the part 110, away from and clear of the entry hole. In the present embodiment, the first and second secondary retained slugs are located on opposite sides of the entry hole.

The initial slug and the first of the two secondary retained slugs are located on the same side of the entry hole.

Figure 5F:
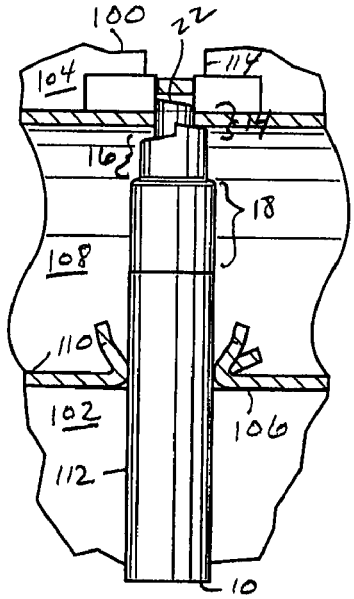

As shown in FIG. 5F, the punch has a length and a stroke distance that exceed the cross-section of the part 110 allowing the end portion 14 to punch through the opposite side of the part 110 creating a smaller exit hole (e.g., through a die button). As the punch 10 is further advanced into the part 110, the cutting edge 22 engages the opposite side of the part 110 and cleanly shears an exit hole opposite the entry hole. The material around the exit hole is not significantly deformed so that the inner surface of the part 110 around the exit hole remains generally flat. The larger diameters of the enlarging portion 16 and/or finishing portion 18 relative to the end portion 14 result in an entry hole being formed that is larger than the exit hole. In embodiments where the punch does not include a finishing portion, the larger diameter of the enlarging portion 16 relative to the end portion 14 results in an entry hole being formed that is larger than the exit hole. The exit slug is pushed out into a bore 114 in the upper die 104 extending from the surface of the die cavity 106. From the bore 114, the exit slug may be removed using conventional means.

As will be appreciated by persons skilled in the art, the punch 10 produces a relatively clean exit hole needing little or no significant cleaning or finishing machining of the part 110 prior to welding, brazing or other manufacturing use. This clean exit hole allows a nut or other fastener to be welded or brazed within the exit hole or about the exit hole on the inner surface of the part 110. Further, the larger diameter of the entry hole provides easier tooling access to the exit hole for operations such as welding.

Figure 6:
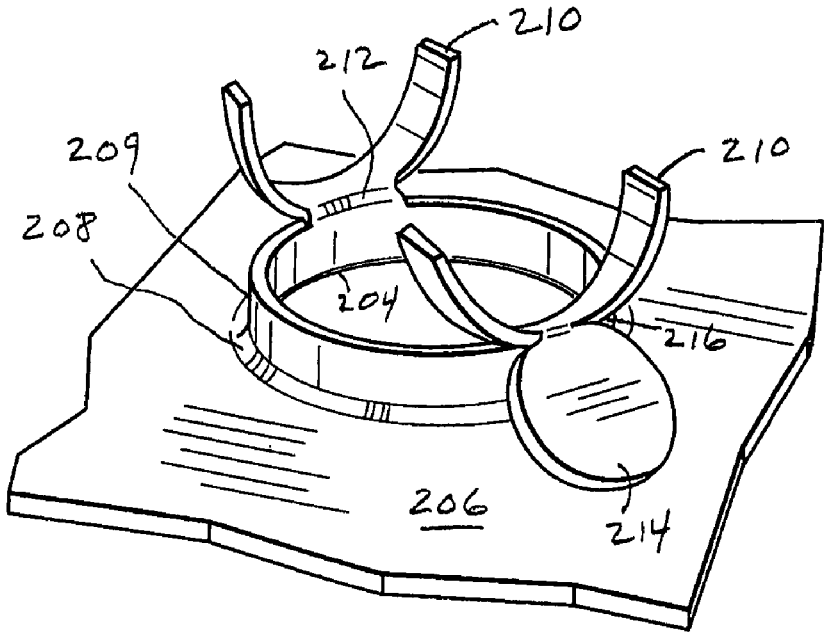
FIG. 6 is a perspective view of the interior of a hollow metal part formed using a punch according to one embodiment of the present invention.
Figure 7:
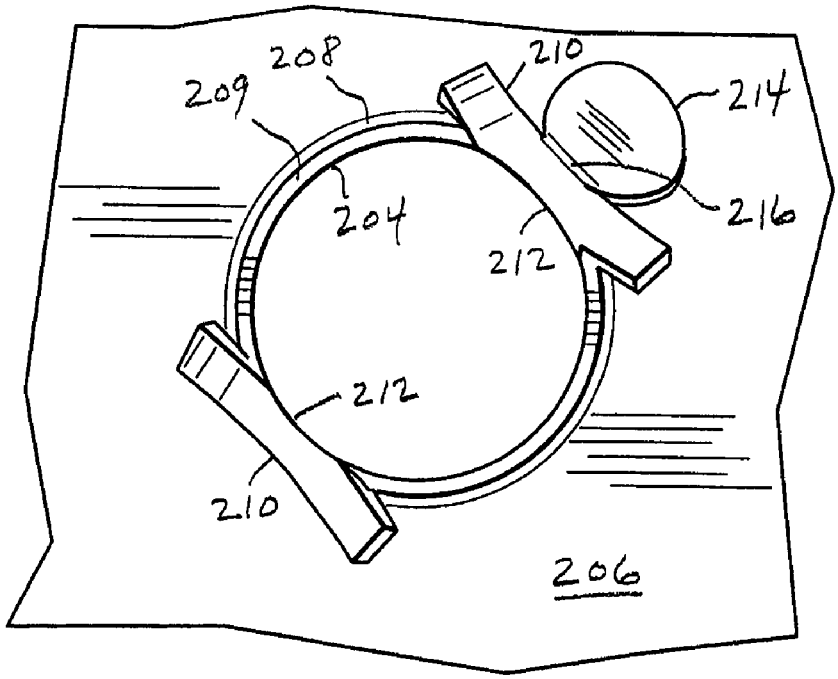
FIG. 7 is a top view of the interior of the hollow metal part of FIG. 6.

Referring now to FIGS. 6 and 7, the hole in a hollow metal part formed using a punch according to one embodiment of the present invention will be described. FIGS. 6 and 7 illustrate the interior of the part 110 showing an inner surface 206 of the entry side of the part 110. The part 110 comprises a hollow metal body, such as a tube, having a flat wall portion. An entry hole 204 is defined in the part. An exit hole (not shown) is defined in the part opposite the entry hole 204. The entry and exit holes are generally circular with the entry hole 204 having a larger diameter than the exit hole.

A rolled edge portion 208 extends around the entry hole 204 along its peripheral edge, and extends towards the interior of the part. A cylindrical portion 209 extends inwardly from the rolled edge portion 208. A pair of slugs 210 is joined to and extends inwardly from an edge 212 of the cylindrical portion 209. The slugs 210 are positioned on opposite sides of the cylindrical portion 209. The slugs 210 are an example of the secondary retained slugs formed by the enlarging portion 16, as described above. In the shown embodiment, the shape of the punch 10 results in the slugs 210 being half-cylindrical arch shaped members. A further slug 214 is joined along an edge 216 of one of the slugs 210. The slug 214 is equivalent to the initial retained slug formed by the end portion 14, as described above.

The ratio of the area of the entry hole to the area of the exit hole may be represented as a hole size ratio. In some embodiments, the hole size ratio is greater than 1.3:1. In some embodiments, the hole size ratio is between 1.3:1 and 3:1.

In some embodiments, the present invention provides a method of forming two opposing holes through an open tube section or other hollow part using a single actuated punch in a single motion. The opposing holes may differ substantially in size, with the entry hole being larger than the exit hole. In the present embodiment, the holes are round, but may be of any desired shape. The resultant slug material from the larger entry hole is retained along the inner edge of the entry hole within the tube section and the smaller exit hole is pierced or cut to form a slug that is pushed out of the tube section and mold cavity. The slug material size varies depending on the size of the entry hole and the difference in size of the opposing entry and exit holes. For smaller ratios, the slug retained along the entry hole may be relatively simple and the punch may have a simpler design than that shown in FIGS. 1-4 because less material may need to be removed to form the entry hole.

According to another embodiment of the present invention, there is provided a method for forming opposing holes of differing size in a hollow part that has been internally pressurized by a hydroforming fluid. The method comprises the steps of: (i) piercing an entry hole in the hollow part without completely shearing a slug; (ii) performing a first rolling step in which material around the entry hole is rolled back to form a retained slug located about the entry hole and extending towards the interior of the hollow part; (iii) performing a second rolling step in which the retained slug and additional material around the entry hole is rolled back further towards the interior of the hollow part; and (iv) forming an exit hole in the hollow part opposite the entry hole. The entry hole is larger than the exit hole.

In some embodiments, the step of forming an exit hole includes punching the exit hole so as to cleanly shear an exit slug from the exterior of the hollow part. The slug may be sheared without deforming the material around the exit hole. The method is performed during a single stroke of a punch.

In some embodiments, in the second rolling step the retained slug and the additional material around the entry hole is rolled back to form rolled edge portions on opposite sides of the entry hole in the interior of the hollow part and extending partially around the entry hole.

In some embodiments, the method includes a third rolling step performed after the second rolling step and before the step of punching the exit hole in the part. The third rolling step includes rolling back the retained slug and additional material around the entry hole further towards the interior of the part. In some embodiments, in the third rolling step the retained slug and additional material around the entry hole is rolled back to form a rolled edge portion extending completely around the entry hole.

In some embodiments, the hole size ratio of the entry hole to the exit hole is greater than 1.3:1. In some embodiments, the hole size ratio of the entry hole to the exit hole is between 1.3:1 and 3:1.

In some embodiments, the present invention provides a method of forming two opposing holes of a substantially different size through a tube section or other hollow part in a forming die. The method seeks to reduce the manufacturing costs (e.g., tool and part costs) relative to alternatives such as laser cutting and other in-die hole forming systems. The method forms the holes using a single punch in a single stroke, thereby reducing die cost and complexity as well as minimizing space occupied within the die. Another advantage is a reduction in die weakening that occurs when cutting multiple mounting locations for multiple punch units. Further, because the punch removes the entry hole (i.e., the slug) material in stages, at any time during the punch stroke the length of material being sheared is reduced compared to a conventional punch where the entire end face of the punch contacts the material at the same time. This facilitates using a smaller punch diameter which creates a further reduction in tool costs. This benefit is applicable for any hydroforming operation, particularly those using higher pressure hydroforming fluid.

In some embodiments, the present invention also seeks to provide improved scrap management and process efficiency by retaining the entry slug along the inner edge of the entry hole and folding the entry slug into the inside of the hollow part rather than completely shearing the slug off. By retaining the slug material about the entry hole, additional scrap handling costs and the risk of damage to die components, tools or subsequent parts is avoided.

In some embodiments, the present invention also seeks to provide improved exit hole quality. By using the sharp cutting edge of the punch to shear the exit hole, a cleaner exit hole may be punched than in alternative approaches where an entry slug is sheared and retained on the end face of the punch during the shearing of the exit hole, thus interfering with the shearing of the exit hole.

In some embodiments, the present invention also seeks to increase the hole size ratio of the entry hole to the exit hole that may be produced compared to that of known methods. If the hole size ratio is too large, the material around the larger entry hole will rupture or crack. These ruptures may form as stress concentrations that may propagate as cracks or fractures and cause further part failure. The rupture point is the hole size ratio at which rupture occurs using conventional tooling and techniques. The rupture point varies depending on material formability, but may occur at ratios as low as 1.3:1 for some materials. In some embodiments, the present invention may be used to produce hole size ratios beyond a conventional rupture point for a given material. In some embodiments, hole size ratios between 1.3:1 and 3:1 may be produced. In yet other embodiments, hole size ratios greater than 3:1 may be produced.

The punches described above are exemplary embodiments and many variations of the punch are possible. For example, in some embodiments the punch may include an end portion and an enlarging portion, but may not include a finishing portion. In such cases, the punch still has a length greater than a cross-section of the part such that further advancement of the punch through the part allows the punch to form an exit hole in the part opposite the entry hole.

Having described exemplary punches made for piercing circular or round holes, it will be understood that the present invention may also be applied to punches for producing holes of various shapes and sizes, and in convex and concave as well as flat wall regions of a hydroformed part. For example, the exemplary punches described above are formed with cylindrical body portions for producing round holes. However, these portions need not be cylindrical and may have other peripheral shapes or profiles for producing non-circular holes.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A hollow metal part, comprising:

a hollow metal body having opposed entry and exit holes, the entry hole being larger than the exit hole, the hollow metal body including:

a rolled edge portion extending around the entry hole, the rolled edge portion extending towards the interior of the part;

a pair of secondary retained slugs joined along an edge of the rolled edge portion, the slugs being located on opposite sides of the rolled edge portion; and a first retained slug joined along an edge of one of the secondary retained slugs.

2. The hollow metal part as claimed in claim 1, wherein a hole size ratio of the entry hole to the exit hole is greater than 1.3:1.

3. The hollow metal part as claimed in claim 1, wherein a hole size ratio of the entry hole to the exit hole is between 1.3:1 and 3:1.

4. The hollow metal part as claimed in claim 1, wherein the entry and exit holes are circular.

5. The hollow metal part as claimed in claim 4, wherein the first retained slug is generally circular, the secondary retained slugs being half-cylindrical in shape.

* * * * *